US007168113B1

(12) United States Patent
Olsen

(10) Patent No.: US 7,168,113 B1
(45) Date of Patent: Jan. 30, 2007

(54) ADJUSTABLE DUST RUFFLE

(76) Inventor: Jennifer Olsen, 7616 Seawind Dr., Las Vegas, NV (US) 89128

( * ) Notice: Subject to any disclaimer, the term of this patent is extended or adjusted under 35 U.S.C. 154(b) by 120 days.

(21) Appl. No.: 10/915,206

(22) Filed: Aug. 9, 2004

Related U.S. Application Data

(60) Provisional application No. 60/493,691, filed on Aug. 7, 2003.

(51) Int. Cl.
*A47G 9/04* (2006.01)

(52) U.S. Cl. ..... 5/493; 5/482

(58) Field of Classification Search ..... 5/493, 5/496, 498, 499, 482, 922, 923; 24/72.5
See application file for complete search history.

(56) References Cited

U.S. PATENT DOCUMENTS

| | | | | |
|---|---|---|---|---|
| 674,609 | A | 5/1901 | Higley | |
| 2,245,779 | A * | 6/1941 | Heil | 5/499 |
| 3,144,666 | A * | 8/1964 | Ragsdale Mazera et al. | 5/493 |
| 3,858,256 | A * | 1/1975 | Beer | 5/496 |
| 3,999,233 | A | 12/1976 | Morris | |
| 4,141,097 | A | 2/1979 | Levinsohn et al. | |
| 4,807,316 | A * | 2/1989 | Whipple | 5/493 |
| 5,271,112 | A | 12/1993 | Bible et al. | |
| 5,749,110 | A | 5/1998 | Gamble et al. | |
| 5,802,637 | A | 9/1998 | Bordo | |
| 6,035,469 | A | 3/2000 | Schrougham | |
| 6,276,009 | B1 | 8/2001 | Schrougham | |

OTHER PUBLICATIONS

Gershman, Maurice, M.D. "Self-Adhering Nylon Tapes." Journal of A.M.A. (vol. 168, No. 7) Oct. 18, 1958.*

* cited by examiner

*Primary Examiner*—Robert G. Santos
(74) *Attorney, Agent, or Firm*—Rob L. Phillips; Greenberg Traurig

(57) ABSTRACT

A versatile dust ruffle includes means for vertically adjusting the position of the dust ruffle on any box spring and bed frame combination. Further, the dust ruffle includes means for adjusting the dust ruffle to fit the perimeter of any size mattress. One or more resilient strips affixed to the dust ruffle and one or more adjustable straps joining ends of the dust ruffle facilitate the unique attributes of the dust ruffle. Importantly, the placement of the dust ruffle is accomplished without having to move or adjust a subject mattress. The one-size-fits-all dust ruffle disclosed herein eliminates the necessity of time-consuming dust ruffle placement which often requires two people. In the past, one person lifts the mattress while the second person positions the dust ruffle. Moreover, the one-size-fits-all also eliminates the necessity of multiple different dust ruffles to accommodate different mattress sizes. In this manner, dust ruffles can be switched from bed to bed without regard of the mattress size.

5 Claims, 3 Drawing Sheets

ADJUSTABLE DUST RUFFLE

CROSS REFERENCE TO RELATED APPLICATIONS

This application claims the benefit of Provisional Application No. 60/493,691 filed Aug. 7, 2003.

FIELD OF THE INVENTION

The embodiments of the present invention relate to bed coverings. More particularly, a one-size-fits-all adjustable bed skirt or dust ruffle eliminates the necessity of moving the mattress prior to the placement or adjustment of the dust ruffle.

BACKGROUND OF THE INVENTION

Bed skirts, or dust ruffles as they are also known, have been around for decades. The primary purpose of a dust ruffle is to conceal unsightly box springs and bed frames which support mattresses. Accordingly, dust ruffles are aesthetically pleasing arrangements of fabric which hang from beneath the mattress to a point near floor level. As the name implies, traditional dust ruffles comprise a single piece of material constructed such that waves or ruffles of material encompass the box spring and bed frame.

Although very popular, in the past dust ruffles have been cumbersome and are often difficult to situate. The difficulty arises in most instances because the mattress must be lifted so that at least a portion of the dust ruffle may be positioned between the mattress and the supporting box spring. In this arrangement, the weight of the mattress retains the dust ruffle in place. Moreover, in the past, dust ruffles have been manufactured in multiple sizes dependent upon the size of the mattress (e.g., king, queen, twin, etc.). Such size restrictions have limited the versatility of previous dust ruffles.

Various dust ruffle designs are disclosed in the patent literature. In fact, some designs purport to relieve the difficulty related to situating a dust ruffle. Nonetheless, none of the prior designs disclose a one-size-fits-all dust ruffle which is easily situated.

SUMMARY OF THE INVENTION

Accordingly, the embodiments of the present invention include a dust ruffle comprising a length of material sufficient to encompass a substantial portion of a mattress perimeter. In a first embodiment, three elastic strips are joined to the dust ruffle in a parallel arrangement along its length. Generally, the elastic strips are attached above a vertical mid-point of the dust ruffle. During use, the elastic strips act to hold the dust ruffle in place on the box spring. Moreover, the elastic strips facilitate a fanciful design and support the dust ruffle material such that the hanging material forms a series of ruffles.

Opposite ends of the dust ruffle are joined to one another by three adjustable elastic straps. In a first embodiment, the elastic straps are simply extensions of the elastic strips which incorporate a ring and slider arrangement for adjustability. The adjustable elastic straps allow the dust ruffle to be fitted to any size mattress. In practice, once adjusted, the elastic straps are situated against a wall or are concealed with a comforter or similar bed covering which hangs over a portion of the box spring.

With the design of the embodiments of the present invention, a single dust ruffle fits any box spring and bed frame combination as well as any mattress size.

DETAILED DESCRIPTION

Figure 1:
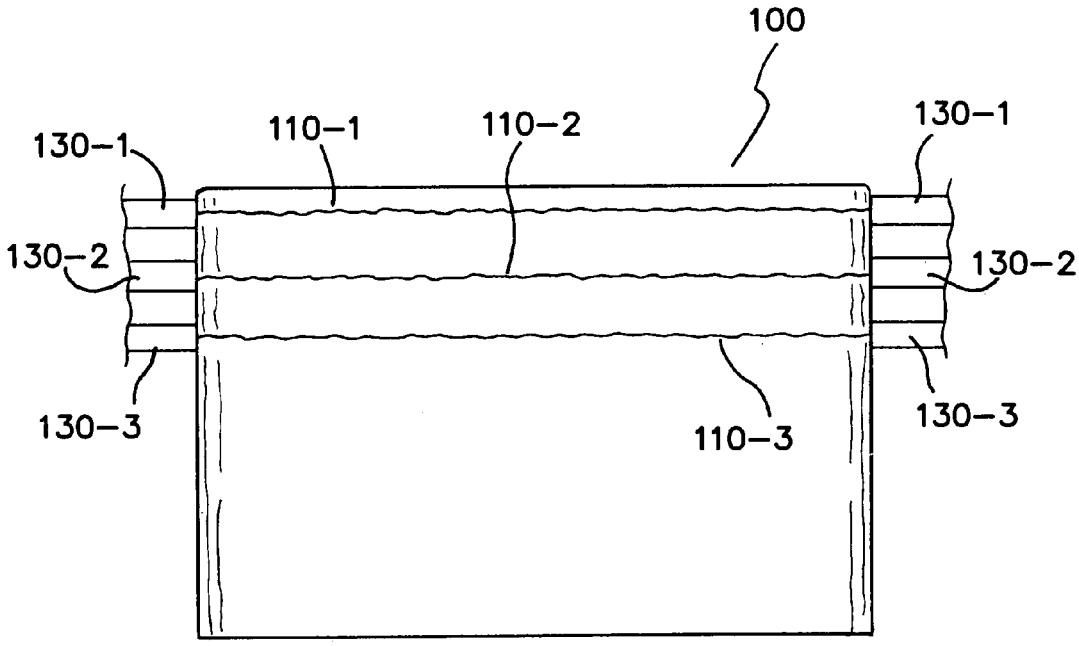
FIG. 1 illustrates an outside view of a first dust ruffle embodiment of the present invention.

Reference is now made to the figures wherein like parts are referred to by like numerals throughout. FIG. 1 illustrates an outside view of a first dust ruffle embodiment of the present invention generally designated a reference numeral 100. The outside view illustrated in FIG. 1 is the view that is exposed when the dust ruffle 100 is situated on a box spring. Three parallel stitches 110-1 through 110-3 run along an upper half of the dust ruffle 100. The stitches 110-1 through 110-3 hold three corresponding elastic strips 120-1 through 120-3 (shown in FIG. 2) in place along an underside of the dust ruffle 100.

Figure 2:
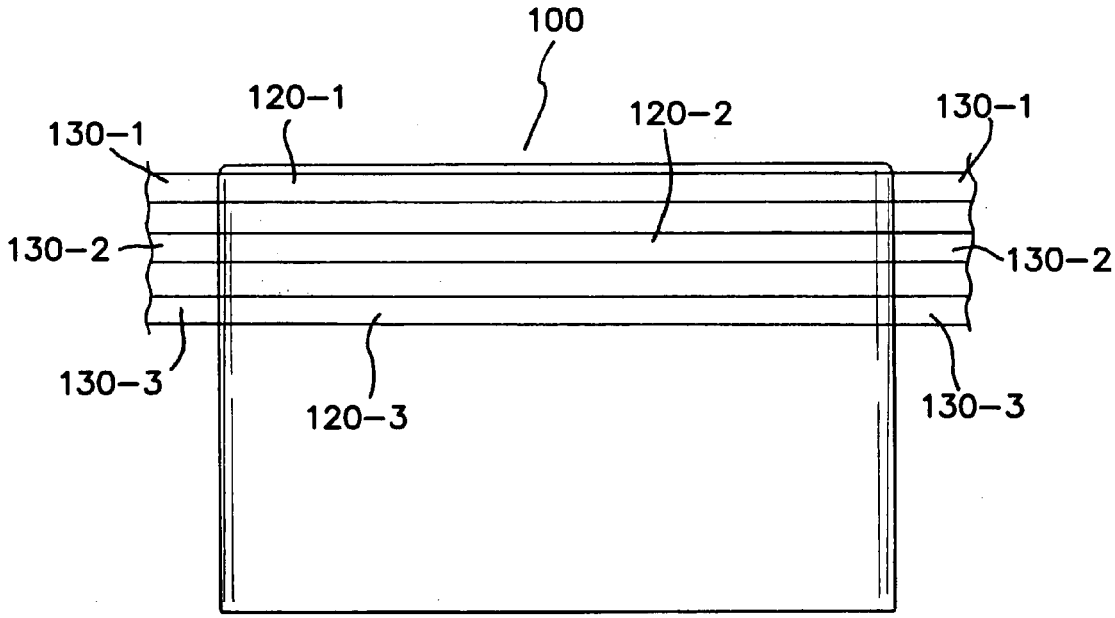
FIG. 2 illustrates an underside view of the first dust ruffle embodiment of the present invention.
Figure 3:
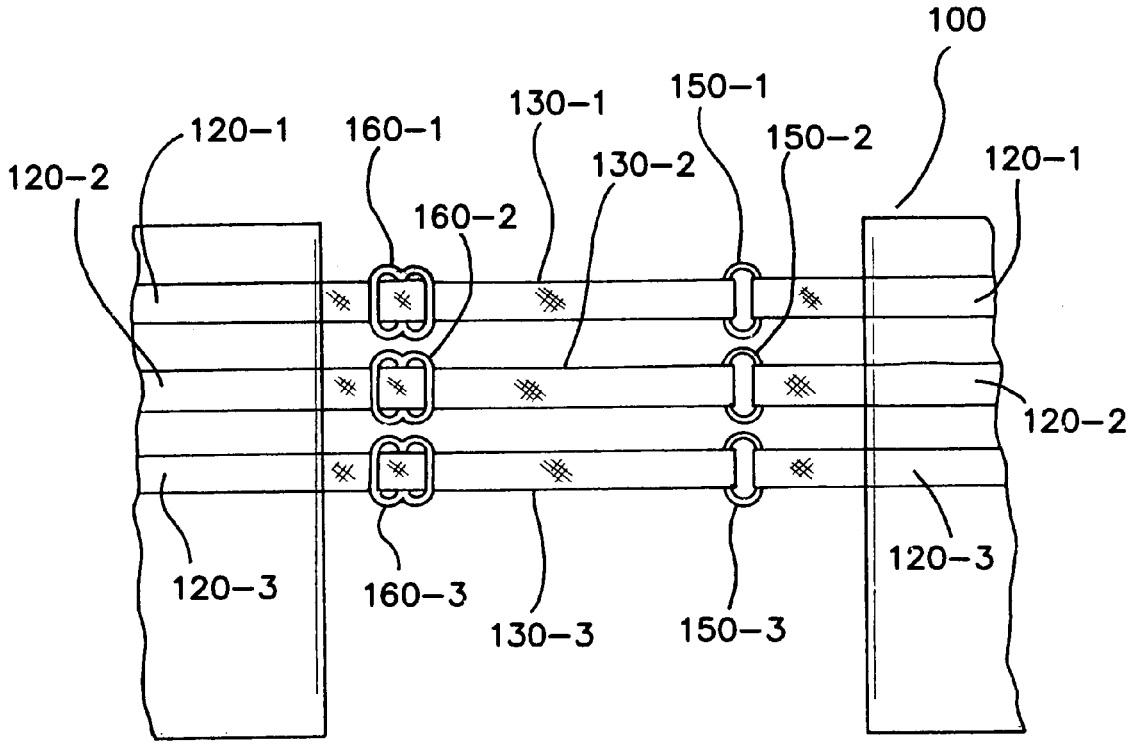
FIG. 3 illustrates a perspective view of elastic straps of the first dust ruffle embodiment of the present invention

Although shown cut away in FIGS. 1 and 2, FIG. 3 shows that the three elastic straps 130-1 through 130-3 extend from the elastic strips 120-1 through 120-3 to join the opposite ends of the dust ruffle 100. Further, as shown more clearly in FIG. 2, in a first embodiment, each strap 130-1 through 130-3 is formed of the same elastic corresponding to the elastic strips 120-1 through 120-3. In other words, each strip 120-1 through 120-3 and corresponding strap 130-1 through 130-3 is fabricated of a single elongated elastic member. In alternative embodiments, multiple elastic members can be used to fabricate each elastic strip 120-1 through 120-3 and corresponding strap 130-1 through 130-3. Other resilient materials may replace the elastic.

Now referring to FIG. 2, the underside of the dust ruffle 100 includes the elastic strips 120-1 through 120-3. Ideally, the strips 120-1 through 120-3 are ideally sewn onto the dust ruffle 100. Moreover, the strips 120-1 through 120-3 are sewn on the dust ruffle material such that the material is bunched on the elastic strips 120-1 through 120-3. In this manner, the material can expand when the elastic strips 120-1 through 120-3 are stretched. Otherwise, stretching the elastic strips 120-1 through 120-3 would be resisted by the dust ruffle material.

Each strip 120-1 through 120-3 extends from opposite ends of the dust ruffle 100 to form a corresponding adjustable elastic strap 130-1 through 130-3. As set forth above, the length of the straps 130-1 through 130-3 is adjusted by means of an arrangement of rings 150-1 through 150-3 and sliders 160-1 through 160-3 as shown in FIG. 3. Alternatively, other adjustment means can be used such as a series of buttons, Velcro® straps and similar means. The adjustment of the straps 130-1 through 130-3 provides the necessary means for the dust ruffle 100 to fit any size mattress.

Figure 5:
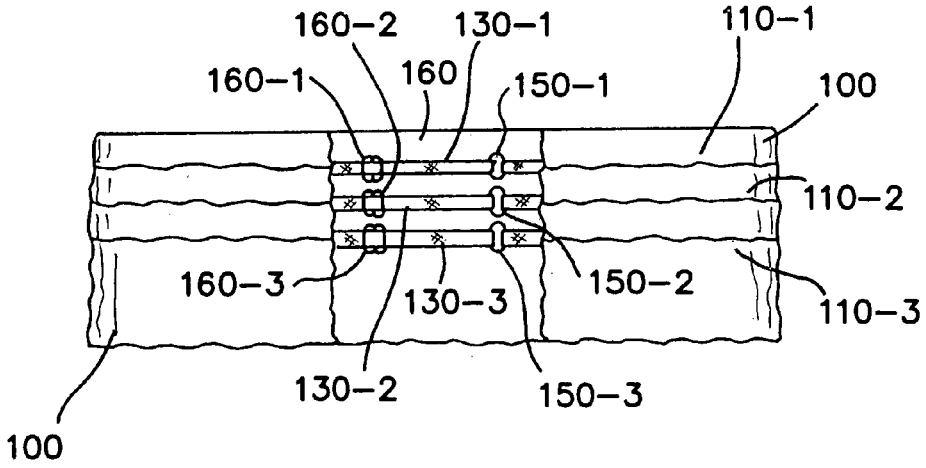
FIG. 5 illustrates an end of the box spring with the dust ruffle in place.
Figure 4:
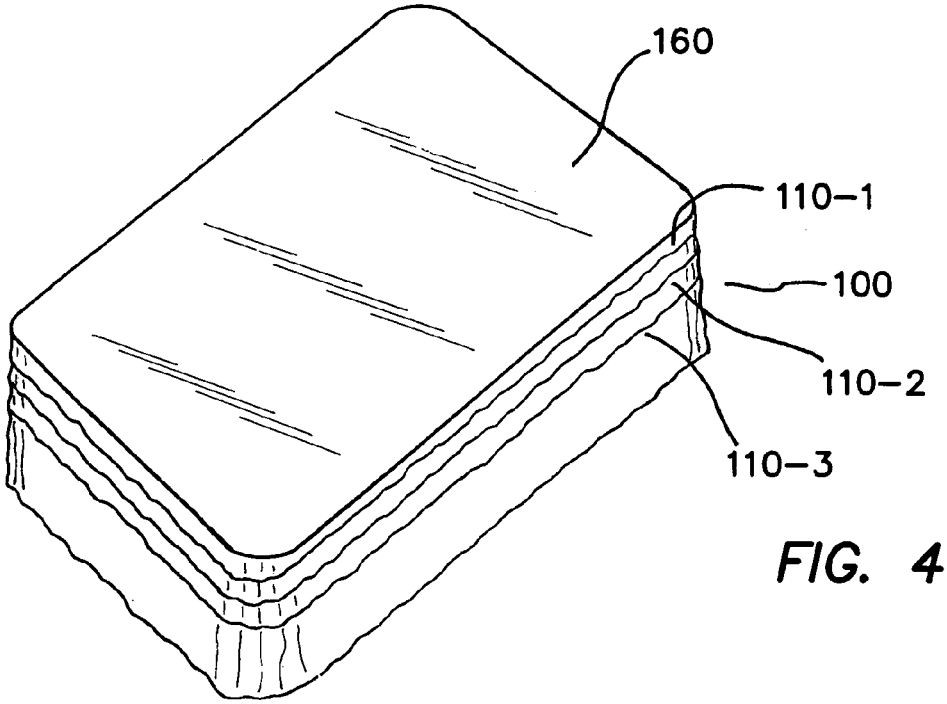
FIG. 4 illustrates a perspective view of the first dust ruffle embodiment of the present invention in place on a box spring with a mattress removed.

FIG. 4 illustrates the dust ruffle 100 in place on a box spring 160 with a mattress removed. FIG. 5 shows the straps 130-1 through 130-3 situated at one end of the box spring 160. In practice, the end of the box spring 160 is placed against a wall to conceal the straps 130-1 through 130-3. Alternatively, the straps 130-1 through 130-3 can be concealed with a comforter or other bed covering which hangs over the mattress and a portion of the box spring 160.

The three parallel strips 120-1 through 120-3 allow a user to adjust the vertical position of the dust ruffle 100. The thickness of box springs and height of supporting bed frames are not universal. Therefore, in the past, in most cases, different combinations of box springs and bed frames have required different dust ruffles. However, the spaced strips 120-1 through 120-3 of the instant invention allow the dust ruffle to be positioned in numerous vertical orientations. For example, as shown in FIG. 4, each strip 120-1 through 120-3 is shown to encompass a perimeter of the box spring 160. Assuming another box spring and bed frame combination have a shorter height than that shown in FIG. 3, the dust ruffle 100 can be positioned more upwardly by only utilizing the bottom two elastic strips 120-2 and 120-3. In this alternative arrangement, strip 120-1 and the surrounding excess dust ruffle material is tucked between, and concealed by, the box spring 160 and mattress. Just as easily, only the bottom strip 120-3 can be used to position the dust ruffle 100 for an even shorter box spring and bed frame combination. In this arrangement, the two upper strips 120-1 and 120-2 and surrounding excess dust ruffle material are tucked between, and concealed by, the box spring 160 and mattress. Alternatively, the strips 120-1 through 120-3 can be compressed near an upper portion of the box spring 160 thereby eliminating the need to tuck the excess dust ruffle material between the box spring 160 and mattress. Either embodiment allows the dust ruffle 100 to be adjusted upward and downward depending on the need.

Although any vertical adjustment parameter is conceivable, the inventor has found that the typical height from an upper surface of a box spring 160 to a floor, depending on the bed frame, is in a range of 14" to 19". Therefore, 5" of vertical adjustability is sufficient to account for most typical box spring and bed frame combinations.

FIG. 3 illustrates the straps 130-1 through 130-3 and their corresponding rings 150-1 through 150-3 and sliders 160-1 through 160-3. By laterally positioning the slider 160-1 through 160-3 along the strap loop 165-1 through 165-3, the length of the corresponding elastic straps 130-1 through 130-3 can be increased or decreased to accommodate any mattress size. The rings 140-1 through 140-3 function to join the first strap section 135-1 through 135-3 to the second strap section 140-1 through 140-3.

Figure 6:
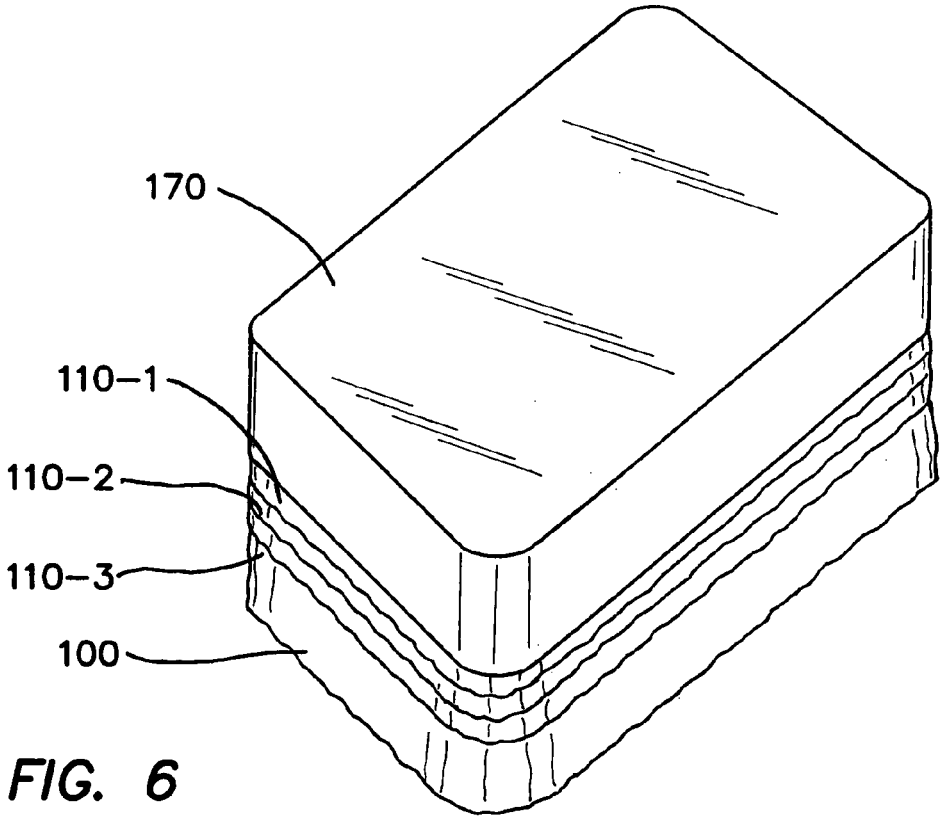
FIG. 6 illustrates a perspective view of the first dust ruffle embodiment of the present invention in place on a box spring with a mattress in place.

The dust ruffle 100 is shown in place in FIG. 6 on a complete bed (i.e., mattress 170, box spring 160 and bed frame). As described above, the dust ruffle 100 covers the box spring 160 and bed frame combination. Unlike previous dust ruffle designs, the embodiments of the present invention provide a versatile dust ruffle 100 which can accommodate any box spring and bed frame combination height as well as any mattress size. Moreover, the dust ruffle 100 can be completely situated without having to move or adjust the subject mattress.

Although the invention has been described in detail with reference to several embodiments, additional variations and modifications exist within the scope and spirit of the invention as described and defined in the following claims.

I claim:

1. An adjustable, one-size-fits-all dust ruffle comprising:
a length of material;
a plurality of resilient strips sewn onto the material; and
a plurality of adjustable resilient straps extending from the strips, said straps joining opposite ends of the length of material and wherein the straps incorporate a ring and a slider arrangement for adjustability.

2. An adjustable, one-size-fits-all dust ruffle comprising:
a length of material;
a plurality of resilient strips sewn onto the material; and
a plurality of adjustable resilient straps extending from the strips, said straps joining opposite ends of the length of material and wherein the straps incorporate one or more buttons for adjustability.

3. An adjustable, one-size-fits-all dust ruffle comprising:
a length of material;
a plurality of resilient strips sewn onto the material; and
a plurality of adjustable resilient straps extending from the strips, said straps joining opposite ends of the length of material and wherein the straps incorporate hook and loop fasteners for adjustability.

4. An adjustable, one-size-fits-all dust ruffle comprising:
a length of material;
a plurality of resilient strips sewn onto the material;
a plurality of adjustable resilient straps extending from the strips, said straps joining opposite ends of the length of material; and
a ring and a slider arrangement for adjusting said straps.

5. The dust ruffle of claim 4 wherein the strips and straps are fabricated of elastic.

* * * * *